United States Patent [19]

Hofmann

[11] 4,356,977

[45] Nov. 2, 1982

[54] FUEL INJECTION NOZZLE

[75] Inventor: Karl Hofmann, Remseck, Fed. Rep. of Germany

[73] Assignee: Robert Bosch GmbH, Stuttgart, Fed. Rep. of Germany

[21] Appl. No.: 235,451

[22] Filed: Feb. 18, 1981

[30] Foreign Application Priority Data

Feb. 21, 1980 [DE] Fed. Rep. of Germany ..... 3006390

[51] Int. Cl.[3] ..... F02M 61/20

[52] U.S. Cl. ..... 239/533.9; 267/20 R

[58] Field of Search ..... 239/533.2–533.12; 217/20 R, 20 A, 20 C

[56] References Cited

U.S. PATENT DOCUMENTS

| | | | |
|---|---|---|---|
| 347,647 | 8/1886 | Schoen | 267/20 R |
| 1,690,893 | 11/1928 | Dorner | 239/533.9 X |
| 1,735,718 | 11/1929 | Attendo | 239/533.6 X |

FOREIGN PATENT DOCUMENTS

| | | | |
|---|---|---|---|
| 195179 | 1/1958 | Fed. Rep. of Germany | 239/533.5 |

*Primary Examiner*—Andres Kashnikow
*Assistant Examiner*—Paul A. Sobel
*Attorney, Agent, or Firm*—Edwin E. Greigg

[57] ABSTRACT

The invention relates to a fuel injection nozzle, in which at least two levers are disposed between the valve needle and the spring support plate of the closure spring, which levers are supported with one end on the housing and the other end on the valve needle, these levers being supported in the middle region on the spring support plate, thereby permitting a certain lever path. As a result it is attained that during this first lever path or a first stroke of the valve needle, because of the action of the levers, the closing force exerted by the spring on the valve needle is reduced in accordance with the lever translation. As a result of this intermediate-position control of the needle stroke, with the creation of a pressure step in consequence, cold-start hammering of the engine is avoided, and quieter operation is made possible, as a result of the resulting prolongation of injection time during idling and at partial load.

11 Claims, 6 Drawing Figures

FUEL INJECTION NOZZLE

BACKGROUND OF THE INVENTION

The invention is based on a fuel injection nozzle of the general type described in the main claim. Fuel injection systems have a comparatively long period of time available for the injection during starting or operation in neutral gear or under light partial load, while this time is comparatively short at higher rpms. The diameter of the nozzle, the stroke of the needle, the closing force and thus the injection pressure are mostly determined by the full-load quantity at maximum rpm. Based upon this, the stroke of the valve needle is relatively uncontrolled during periods of low rpm, especially during starting as well as during operation in neutral gear or under low loads. This makes it possible for the valve needle to open fully because of a pressure surge and the entire, relatively small quantity of fuel is injected at once. This causes relatively noisy running of the engine. On the other hand, it is also possible that the valve needle may begin to move erratically because of oscillations of the spring or pressure waves in the supply line, which results in the so-called cold-start hammering of the engine.

In order to control the movements of the valve needle during starting or low rpm, it is known to provide a so-called pressure step, i.e. the forces acting on the valve needle in the direction of the opening are decreased, e.g. by disengagement of the pressure surfaces; or the forces acting in the direction of closure are increased, e.g. by addition of a spring. Both courses lead to a pressure step in regard to the injection pressure, which is generally desired within the area of between 10 and 30% of the opening lift of the valve needle. These known fuel injection nozzles, however, are comparatively expensive to make, since these nozzles are mostly made in small production runs, which therefore require a comparatively high production outlay. Furthermore, few production parts of large-scale production injection nozzles can be utilized.

OBJECT AND SUMMARY OF THE INVENTION

The fuel injection nozzle according to the present invention with the characteristics of the main claim, however, has the advantage of being considerably less expensive to produce than the known fuel injection nozzles of this type, especially since they allow the use of a normal production nozzle. In addition, the pressure step of the fuel injection valve according to the present invention remains the same without variation, even after long periods of usage, in contrast to the case where a spring is added, and remains so even when injections occur in rapid sequence because of the lesser hysteresis, in contrast to the engagement or disengagement of (pressure) surfaces [as provided in the prior art].

By means of the characteristics shown in the dependent claims, an advantageous further development and improvement of the fuel injection nozzle according to the main claim is possible. It is important for the invention that part of the closure force during closed nozzle or during the first portion of the stroke is transferred to the nozzle housing by means of the lever, which causes a corresponding reduction of the closure force acting on the valve needle.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
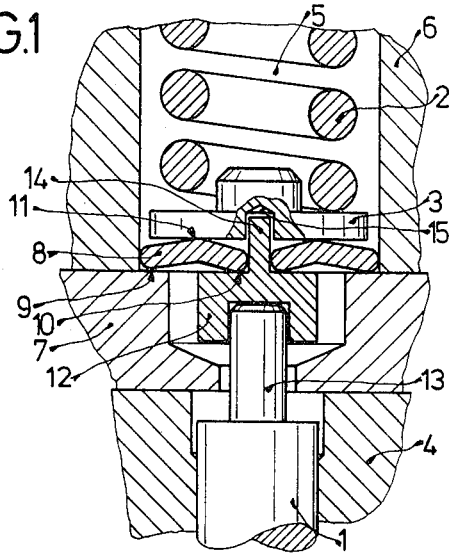
FIGS. 1 to 3 show the first embodiment in longitudinal cross section in different lift positions.
Figure 2:
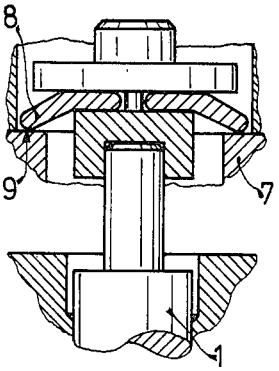
Figure 3:
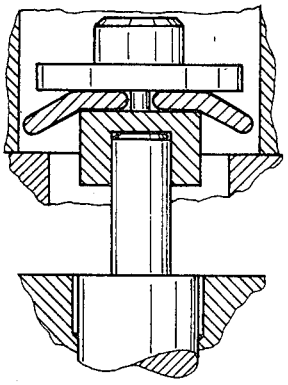

A valve needle 1 of a fuel injection nozzle is stressed in the direction of the closure by means of a closure spring 2 with interposition of a spring support plate 3. The valve needle 1 is guided in an axially movable and radially sealing fashion in a nozzle body 4, which also includes the pressure chamber (not shown), into which the valve needle 1 enters with one plane acting in the direction of the opening, and which is connected with the fuel injection pump by means of a pressure line. Closure spring 2 and spring support plate 3 are disposed in a preferably pressure-relieved chamber 5 of the nozzle holder 6. The nozzle body 4 is fixed to the nozzle holder 6 by means of a sleeve nut (not shown).

In the first two embodiments shown in FIGS. 1 to 5, an intermediate plate 7 is disposed between the nozzle body 4 and the nozzle holder 6, which serves, with the front end oriented towards the valve needle 1, as a limiting stop for the maximum stroke of the valve needle 1. Levers 8 are disposed between valve needle 1 and the spring support plate 3, which are braced with their outer ends at 9 against the intermediate plate 7 and at 10 against an extension of the valve needle 1. These levers 8 are curved in such a way that curved in such a way that they touch the front end of the spring support plate 3, with their middle area at 11, oriented toward the valve needle 1.

According to where the contact point 11 is located in respect to points 9 and 10, part of the force of spring 2 on the housing of the injection nozzle is transferred here at point 9 to the intermediate plate 7. The other part acts by way of point 10 on the valve needle 1. As soon as a pressure sufficient to overcome this other part of the force has been generated in the pressure chamber of the injection nozzle, the valve needle is displaced into the position shown in FIG. 2, thus releasing the injection opening for the injection. In this position shown in FIG. 2, the levers 8 have been displaced by the valve needle 1 in such a way that their outer ends just lift from the intermediate plate 7 at point 9. In this way the entire force of the spring 2 is transferred to the valve needle 1. Only when the pressure has risen comparatively higher, to about twice its force in the example depicted, the valve needle with levers and spring plates is moved into its end position defined by the intermediate plate 7. In the first two embodiments shown in FIGS. 1 to 5, a pressure plate 12 is disposed between valve needle 1 and levers 8 or the spring support plate 3, which is guided on its end oriented towards the valve needle 1 by the pin 13 of the latter and which engages a blind bore 15 of the spring support plate 3 with a pin 14 for its own guidance. In this manner a production nozzle with intermediate plate 7 can be equipped with levers 8, without having to forego the intermediate plate.

Figure 4:
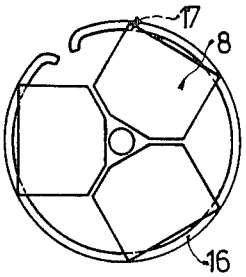
FIG. 4 shows the first embodiment in plan view.
Figure 5:
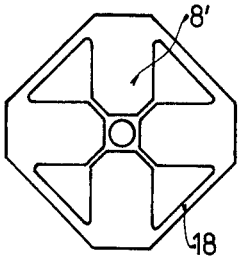
FIG. 5 shows the second embodiment in plan view.

FIGS. 4 and 5 show the first and second embodiments in plan view. In the first embodiment according to FIG. 4, there are three single levers 8, which are kept together by means of a spring tensioning ring 16. This spring tensioning ring 16 engages corresponding grooves 17 disposed on the outer corners of the levers 8. These levers could, for instance, be of formed sheet metal. In the second embodiment shown in FIG. 5, however, the levers 8' are sections of a unitized part. In the example, four levers are connected with one another by means of bars 18 which supplant the tensioning or holding ring 16.

Figure 6:
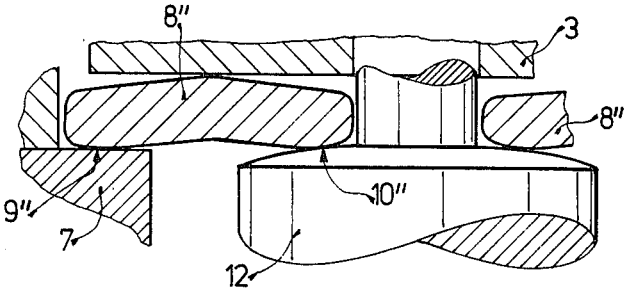
FIG. 6 shows the third embodiment in partial longitudinal cross section.

In the third embodiment shown in FIG. 6, the areas of the levers 8'' oriented towards the points 9'' and 10'' are spherically constructed. The same goes especially for the corresponding seating area on the pressure plate 12. In this manner, the transfer of the spring force to the valve needle does not increase in spurts as the opening stroke increases, but in the manner of a transition, so that the fuel pressure, too, increases in relation to this first opening stroke portion in accordance with the stroke. This leads to a better agreement between nozzle diameter and injection quantity and prevents excessive oscillation of the valve needle 1 during the first lift stage.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines having a radially sealing valve needle axially displaceable by the fuel supplied under pressure and arranged to open in the opposite direction to the fuel flow, said valve needle stressed in the closing direction by a closure spring engaging the valve needle via a spring support plate, characterized in that at least two levers have portions arranged to contact a shelf area of an apertured member which encircles an area of said valve needle and another of said portions of said levers engage said spring supporting plate.

2. A fuel injection nozzle as defined by claim 1, characterized in that said levers further include end areas each of which are curved away from said spring support plate.

3. A fuel injection nozzle as defined by claim 1 or 2, characterized in that said valve needle further includes an upstanding pin element which projects into a recess in a pressure plate, said pressure plate further including a pin member which intersects said levers and thereafter enters an aperture in said spring support plate.

4. A fuel injection nozzle as defined by claim 1, characterized in that said levers are further embodied in spherical form at a point where they engage said shelf area.

5. A fuel injection nozzle as defined by claim 3, characterized in that said levers are further embodied in spherical form at a point where they engage said pressure plate.

6. A fuel injection nozzle as defined by claim 5, characterized in that said levers further include contact faces which are arched in an axial direction.

7. A fuel injection nozzle as defined by claim 1, characterized in that said levers are disposed radially symmetrically with respect to the axis of said valve needle and further that said levers are retained in a relatively secure position so that said levers may pivot relative to said valve needle.

8. A fuel injection nozzle as defined by claim 7, further wherein said levers are retained against radial movement by a ring member.

9. A fuel injection nozzle as defined by claim 8, further wherein said ring member is provided with means defining openings and said levers have portions which enter said means defining said openings.

10. A fuel injection nozzle as defined by claim 1, characterized in that said levers are unitized into a single element.

11. A fuel injection nozzle for internal combustion engines having a valve needle axially displaceable by the fuel supplied under pressure and stressed in the closing direction by a closure spring engaging the valve needle via a spring supporting plate, characterized in that the spring supporting plate engaging the valve needle via at least two levers each having end portions arranged to contact shelf areas on the valve housing and the valve needle and having an intermediate portion engages said spring supporting plate.

* * * * *